US009585453B2

(12) United States Patent
Lash

(10) Patent No.: US 9,585,453 B2
(45) **Date of Patent: *Mar. 7, 2017**

(54) DEVICE FOR CLAMPING THICK, TEXTURED OR COILY HAIR

(71) Applicant: PuffCuff LLC, Marietta, GA (US)

(72) Inventor: Ceata E. Lash, Marietta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/242,945

(22) Filed: Apr. 2, 2014

(65) Prior Publication Data

US 2015/0282583 A1 Oct. 8, 2015

(51) Int. Cl.
*A45D 8/30* (2006.01)
*A45D 8/28* (2006.01)

(52) U.S. Cl.
CPC . *A45D 8/30* (2013.01); *A45D 8/28* (2013.01)

(58) Field of Classification Search
CPC ... A45D 8/00; A45D 8/34; A45D 2/44; A45D 2008/004; A45D 2008/006; A45D 2008/345; A45D 8/12; A45D 8/38
USPC ..... 132/106, 133, 273, 275; D28/21, 23, 28, D28/33
See application file for complete search history.

(56) References Cited

U.S. PATENT DOCUMENTS

| | | | | | |
|---|---|---|---|---|---|
| 573,887 | A | * | 12/1896 | Kraus | 132/133 |
| 712,657 | A | * | 11/1902 | Davis | 132/106 |
| 918,203 | A | * | 4/1909 | Schwarzer | 132/133 |
| 1,596,737 | A | * | 8/1926 | Johnson | 132/133 |
| 2,159,709 | A | * | 5/1939 | Quetin | 132/133 |
| D154,205 | S | | 6/1949 | Fulkerson | |
| 2,569,659 | A | | 10/1951 | Dombek | |
| D180,713 | S | | 7/1957 | Hammond | |
| 2,902,042 | A | * | 9/1959 | Halber | 132/133 |
| D188,158 | S | | 6/1960 | Dorr | |
| D188,363 | S | | 7/1960 | Dorr | |
| 5,174,312 | A | | 12/1992 | Adams | |
| 5,655,550 | A | * | 8/1997 | Keating | 132/133 |
| 5,775,343 | A | * | 7/1998 | Zarn | 132/210 |
| 5,937,867 | A | * | 8/1999 | Williams | 132/201 |
| D415,855 | S | * | 10/1999 | Fergusson | D28/40 |
| 6,484,728 | B1 | | 11/2002 | Chang | |
| 7,581,547 | B2 | | 9/2009 | Pena | |

(Continued)

FOREIGN PATENT DOCUMENTS

FR 395897 * 12/1908

*Primary Examiner* — Todd E Manahan
*Assistant Examiner* — Jennifer Gill
(74) *Attorney, Agent, or Firm* — John G. Posa; Belzer PC

(57) ABSTRACT

A device for clamping thick, textured, coiled or kinky hair includes first and second curved components, each with an outer edge and an inner concave curved edge between first and second ends. The inner concave edges include a plurality of inwardly directed, spaced-apart teeth. A hinge joins the first ends of the curved components, enabling the second ends of the components to open and close around a bundle of hair with the teeth penetrating into the bundle. A cooperating closure maintains the device in position around the bundle of hair. The ends of the teeth define an opening even when the device is closed around the bundle of hair. The first and second curved components are preferably integrally formed from molded plastic. The cooperating closure may include first and second hook shapes. The device may come in different sizes to accommodate different hair textures and styles of children and adults.

6 Claims, 3 Drawing Sheets

(56) References Cited

U.S. PATENT DOCUMENTS

| | | | | |
|---|---|---|---|---|
| 8,789,537 | B2 | 7/2014 | Loredo | |
| D715,997 | S * | 10/2014 | Lash | D28/40 |
| 2007/0283976 | A1 | 12/2007 | Adams | |
| 2010/0078036 | A1 * | 4/2010 | Naji | 132/200 |
| 2013/0160784 | A1 * | 6/2013 | Loredo | 132/200 |

* cited by examiner

FIG. 1
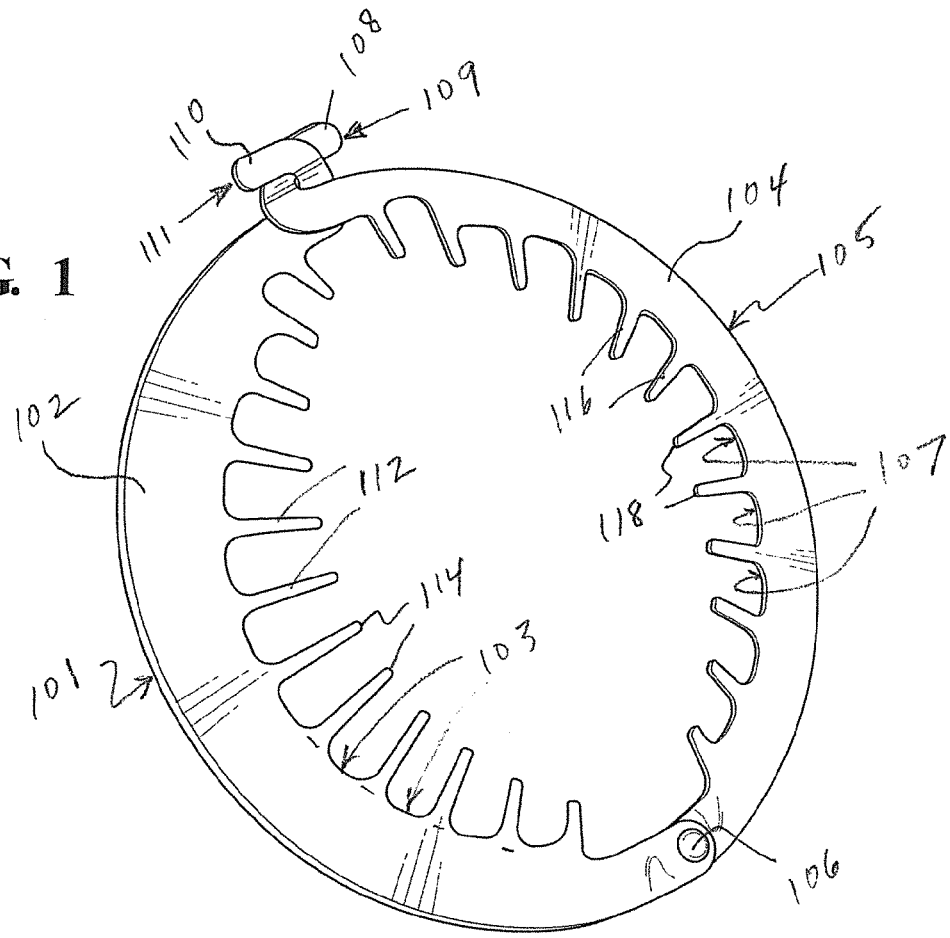
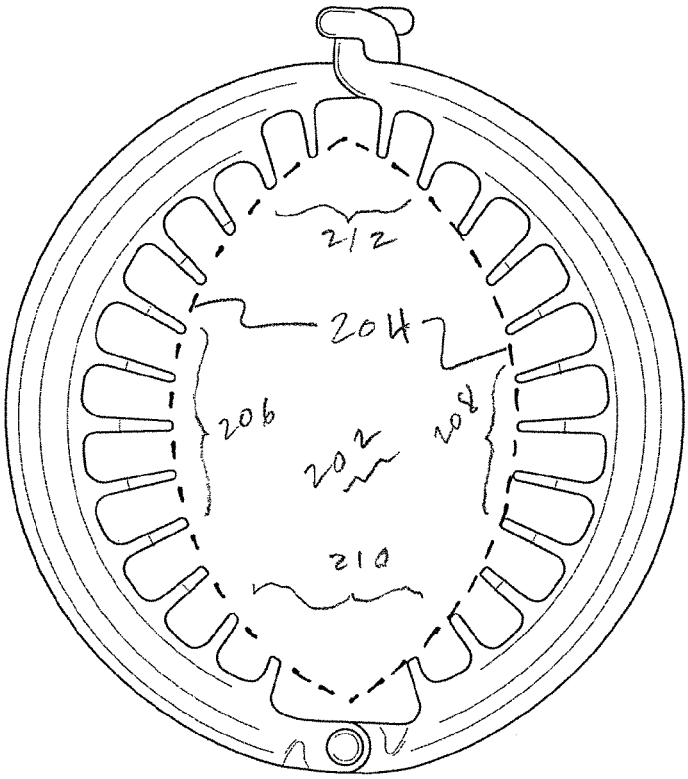
FIG. 2

DEVICE FOR CLAMPING THICK, TEXTURED OR COILY HAIR

FIELD OF THE INVENTION

This invention relates generally to hair accessories and, in particular, to a hair clip for thick, textured or coily hair.

BACKGROUND OF THE INVENTION

Most hair styling accessories are designed for straight hair, and they cannot accommodate thick textured or coily hair. Hair ties, including "scrunchies," are difficult to get around and remove from thick gatherings of textured hair, and since the teeth of "banana clips" overlap, the jaws are too small. Again, banana clips are really intended for straight hair.

SUMMARY OF THE INVENTION

This invention resides in a sanitary, durable and affordable device that clamps thick, textured, coiled or kinky hair without over-squeezing. The device includes first and second curved components, each component having an outer edge and an inner concave curved edge between first and second ends. The inner concave edge of each component includes a plurality of inwardly directed, spaced-apart teeth. A hinge joins the first ends of the curved components, enabling the second ends of the components to open and close around a bundle of hair with the teeth penetrating into the bundle.

A cooperating closure associated with the second ends of the components is used to maintain the device in position around the bundle of hair. In contrast to existing devices, the teeth of one component never touch or bypass the teeth of the other component. Rather, the ends of the teeth define an opening even when the device is closed around the bundle of hair. In the preferred embodiment, the ends of the teeth define a biconvex opening when the device is closed around the bundle of hair.

The first and second curved components are preferably integrally formed from molded plastic, for example. The cooperating closure may include first and second hook shapes on the second ends of the first and second curved components. The device may come in different sizes to accommodate different hair textures and styles of children and adults. For instance, the outer edges of the first and second may define a diameter or dimension in the range of 1 to 5 inches. The length of the teeth may vary from shorter near the ends of the components to longer in the middle, and the outer edges of the first and second curved components may define substantially smooth convex curves.

BRIEF DESCRIPTION OF THE DRAWINGS

FIG. 1 is an oblique of the preferred embodiment of the invention in a closed position;

FIG. 2 is a top view in the closed position;

DETAILED DESCRIPTION OF THE INVENTION

Figure 3:
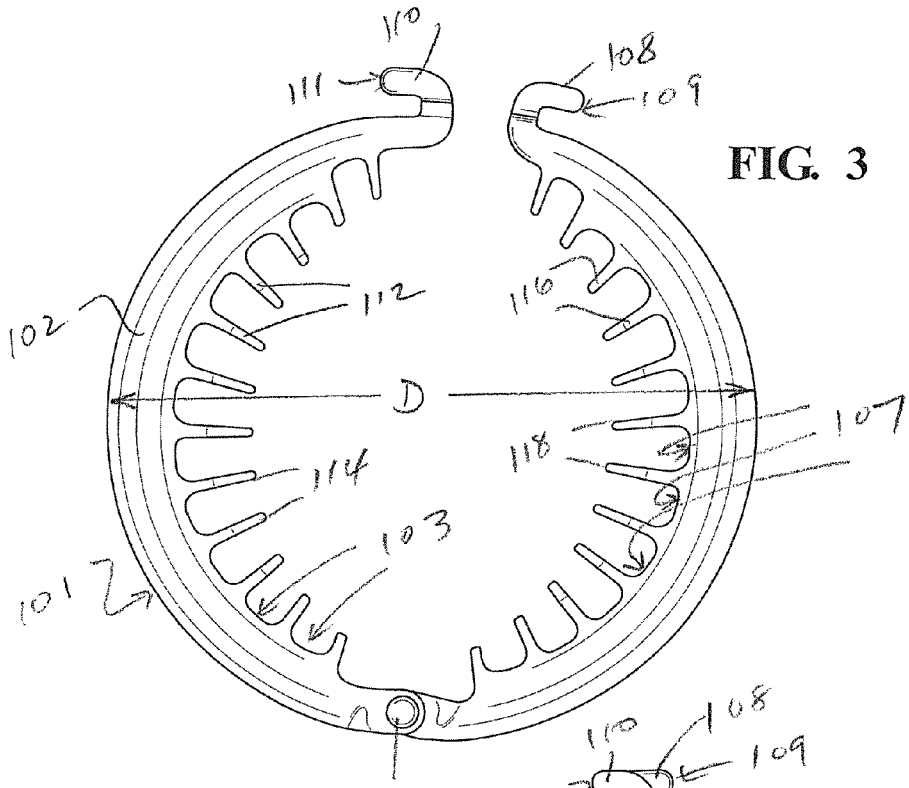
FIG. 3 is a top view in a slightly open position.
Figure 4:
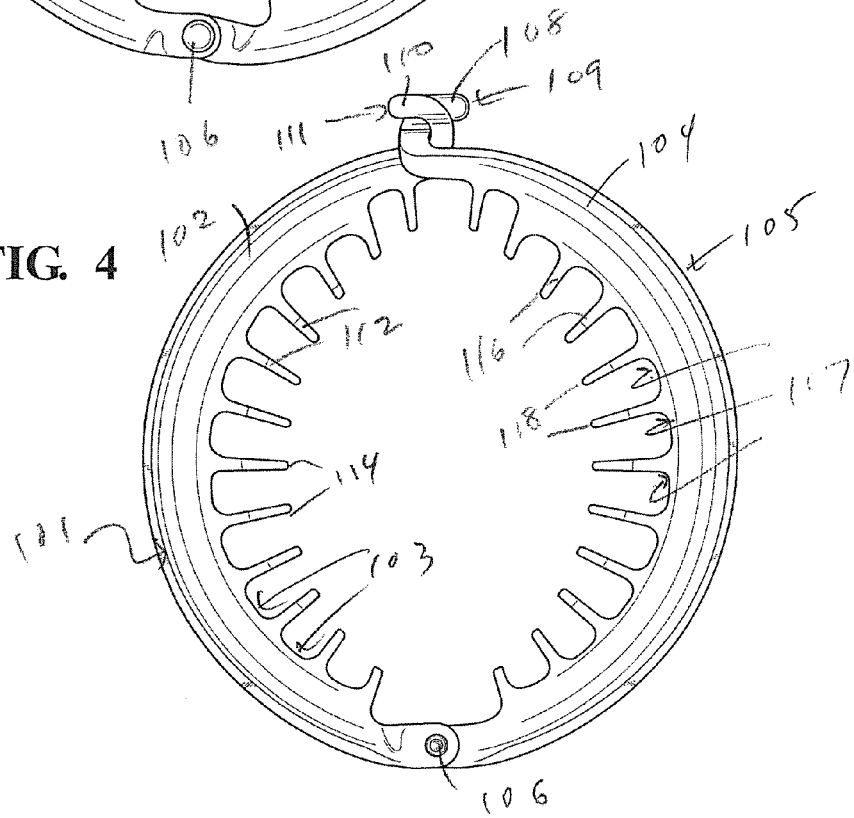
FIG. 4 is a bottom view.
Figure 5:
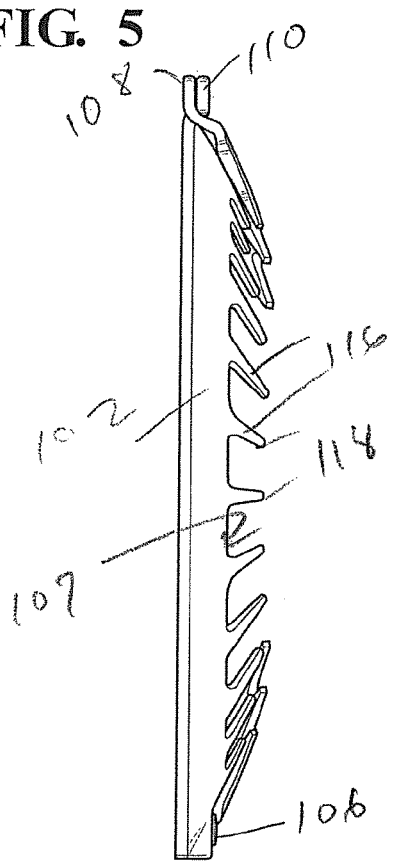
FIG. 5 is a view from one side.
Figure 6:
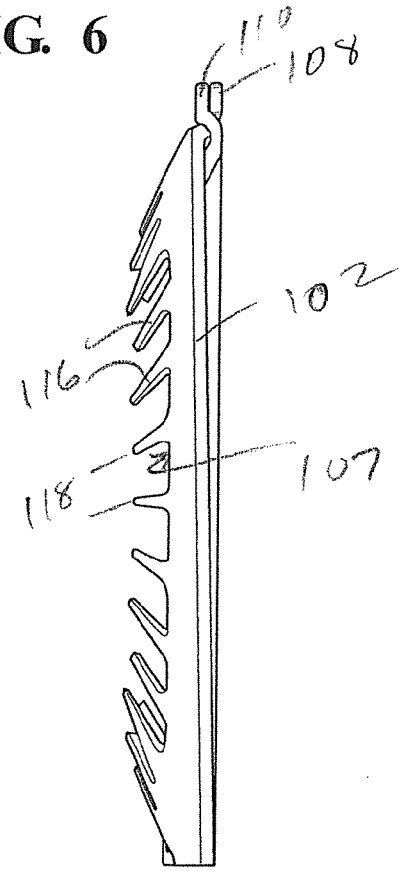
FIG. 6 is a view from another side.
Figure 7:
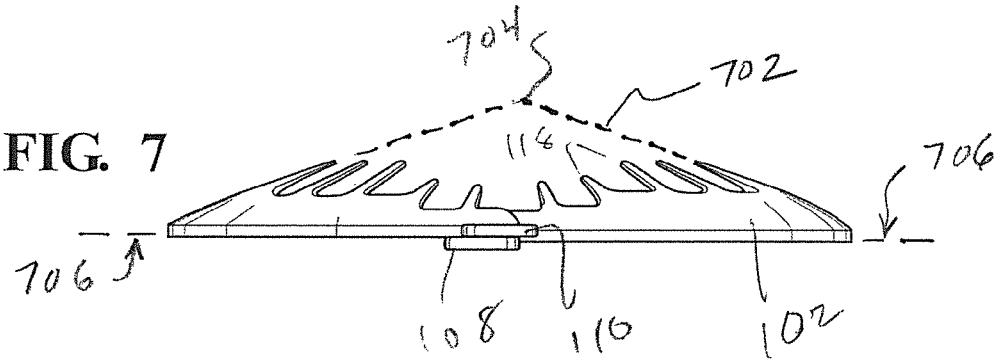
FIG. 7 is a view from the side showing the closure.
Figure 8:
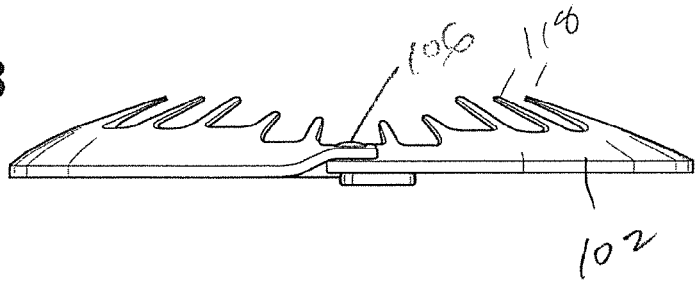
FIG. 8 is a view from the side showing the hinge.

The drawings present different views of the preferred embodiment of the invention. FIG. 1 is an oblique view of the device in a closed position. The device comprises a first curved component 102 and a second curved component 104 connected with a hinge 106, allowing the opposing ends to open and close like jaws. The components are preferably made from a rigid or semi-rigid durable material such as ABS, nylon or other plastics, through materials such as wood or metals may be used. In the preferred embodiment, each component is a unitary structure made from integrally molded plastic, for example, with a plastic or metal rivet being used for hinge 106. The device may come in different sizes, with the dimension "D" in FIG. 3 being in the range of 1.5 to 5 inches to accommodate children and adults with different hair styles and textures. For example, devices with outer sizes of 1.5", 2.25", 3.5" and 5" may be provided. The device may be made in any color(s), including colors to blend in with hair colors or contrast with typical hair colors.

Component 102 includes an outer edge 101 and an inner edge 103 from which there projects a plurality of spaced-apart inwardly directed teeth 112 with tips 114. Likewise, component 104 includes an outer edge 105 and an inner edge 107 from which there projects a plurality of spaced-apart inwardly directed teeth 116 with tips 118. In contrast to existing hair clamps, including the "banana clip," the teeth 112 or tips 114 of component 102 never touch or bypass the teeth 116 or tips 118 of component 104. Rather, even when the device is closed, the tips of both sets of teeth leave a central opening 202 shown in FIG. 2 to better accommodate a gathering of thick, textured or coily hair. In the preferred embodiment, this opening approximates a bi-convex shape shown with broken lines 204. The teeth are preferably angled so as to project generally radially inwardly toward the center of opening 202, with the length of the teeth being graduated from longer teeth 206, 208 near the middle of the device to shorter teeth 210, 212 toward the ends. The teeth may have lengths in the range of ¼ inch or less, to 1 inch or more, depending upon the outer dimension "D."

At the end of the device opposite the hinge 106, a closure mechanism is provided to keep the device in place around a gathering of hair. In the preferred embodiment, component 102 includes a C-shaped hook of material 110 that engages with a corresponding C-shaped hook of material 108 on component 104 as shown in FIGS. 1, 2 and 4-8. As best seen in FIGS. 5-8, the components and teeth are preferably angled to approximate a frustoconical form 702 terminating in point 704. As evident form the figures, the two components 102, 104 are nearly mirror images of one another, with slight differences around the hinge and closure to better maintain a flat front plane 706.

To use the device, hair is gathered with the hand(s) of the user to create a bundle to be clamped. The device is opened more than that shown in FIG. 3. With the bundle of hair maintained with one hand, the opened device is placed around the bundle with the other, at which point both hands may be used to close the device around the bundled. The device is initially is "over-closed" so that the ends 109, 111 of the hooks 108, 110 in FIG. 1 engage, enabling the device to be left in place. In the preferred embodiment, flat plane 706 is oriented toward the head of the wearer with the point 704 of the conical shape pointing backward so that the device essentially "cups" the back of the head to be less conspicuous.

The invention claimed is:

1. A device for clamping thick, textured or coily hair, consisting of:

first and second components integrally formed form molded plastic, each of the first and second components having an inner and an outer convex curved edge between first and second ends;

the inner edge of each component including a plurality of inwardly directed, spaced-apart teeth, each tooth terminating in a free end with a length of the teeth varying from shorter near the first and second ends of the first and second components and longer in a middle of the first and second components;

a single hinge joining the first ends of the curved components enabling the second ends of the components to open and close around a bundle of hair with the teeth penetrating into the bundle of hair;

a cooperating closure associated with the second ends of the first and second components for maintaining the device in position around the bundle of hair, the cooperating closure enabling the device to have an open position and a closed position; and wherein the cooperating closure includes first and second hook shapes on the second ends of each of the first and second components;

wherein the teeth of the first component never touch or bypass the teeth of the second component, and when the device is in the closed position, the free ends of the teeth define a biconvex device devoid of any structures comprising the device wherein the first and second components approximate a frusto-conical shape in a side view of the device; and wherein the outer convex curved edges of the first and second components define a maximum dimension in the range of 1 to 5 inches.

2. The device of claim 1, wherein the first and second curved components and teeth associated therewith are mirror images of one another.

3. The device of claim 1, wherein the outer edges of the first and second curved components are smooth convex curves.

4. The device of claim 1, wherein the molded plastic material is one of ABS or nylon.

5. The device of claim 1, wherein the single hinge is a plastic or a metal rivet.

6. The device of claim 1, wherein the length of the teeth lies in a range of about ¼ inch to 1 inch.

* * * * *